United States Patent [19]

Vallee

[11] 4,218,857

[45] Aug. 26, 1980

[54] METAL SHINGLE ROOF MODERN DESIGN

[76] Inventor: Louis L. Vallée, 6392 Maubourg Ave., Montreal, Quebec, Canada, H1M 2C8

[21] Appl. No.: 887,613

[22] Filed: Mar. 17, 1978

[30] Foreign Application Priority Data

Dec. 14, 1977 [CA] Canada ..... 293053

[51] Int. Cl.[2] ..... E04D 1/00; E04B 7/00

[52] U.S. Cl. ..... 52/94; 52/530; 52/532

[58] Field of Search ..... 52/519, 530, 528, 529, 52/520, 521, 554, 545, 798, 539, 57, 94, 518, 556

[56] References Cited

U.S. PATENT DOCUMENTS

| | | | |
|---|---|---|---|
| 158,123 | 12/1874 | Ravoux | 52/545 |
| 262,475 | 8/1882 | Repp | 52/532 |
| 329,789 | 11/1885 | Weast | 52/530 |
| 406,024 | 7/1889 | Burton | 52/530 |
| 818,333 | 4/1906 | Baden | 52/538 |
| 1,186,619 | 6/1916 | Tiefel | 52/531 |
| 1,204,885 | 11/1916 | Koerwer | 52/529 |
| 1,483,882 | 2/1924 | Harvey | 52/552 |
| 2,601,833 | 7/1952 | Olsen | 52/94 |
| 3,254,460 | 6/1966 | Bowser | 52/94 |
| 4,014,152 | 3/1977 | Vallee | 52/528 |

FOREIGN PATENT DOCUMENTS

| | | | |
|---|---|---|---|
| 7530 | of 1838 | United Kingdom | 52/554 |
| 1108 | of 1872 | United Kingdom | 52/543 |
| 697514 | 9/1953 | United Kingdom | 52/530 |

*Primary Examiner*—John E. Murtagh

*Attorney, Agent, or Firm*—Larson, Taylor and Hinds

[57] ABSTRACT

A sheet metal starter shingle and a roof covering employing the starter shingle. The starter shingle is five sided with a first side engaging with the eave edge of a roof, two sides perpendicular to the first side, and two other sides angled inwardly from the perpendicular sides to meet at a peak opposite the first side. All the sides have means for engaging with adjacent starter shingle, roofing shingles or the roof eave edge. The roof covering employing the starter shingle also employs rectangular, sheet metal roofing shingles each having a length twice its width, and a width equal to one of the angled sides of the starter shingle. A method for laying the roof covering is also disclosed.

10 Claims, 21 Drawing Figures

METAL SHINGLE ROOF MODERN DESIGN

This invention is directed toward an improved sheet material starter shingle.

The invention is also directed toward an improved roof covering employing the sheet material starter shingles.

The invention is further directed toward a method for constructing the improved roof covering.

Sheet material shingles and roof coverings are well known. The shingles and roof coverings are usually made from sheet metal, used to increase the life of a roof covering. The shingles have means whereby adjacent sides can tightly engage in overlapping fashion to provide a substantially weathertight roof. Because of the engaging means on the rigid shingles it is important to have the shingles properly aligned over the entire roof area so as to obtain a substantially weathertight roof covering. To this end, it is important to have the first or starter row of shingles properly aligned since each succeeding row depends for its alignment on the previous row and, in the end, primarily on the alignment of the starter row.

Little attention has been paid to the starter row of shingles in the past. Normally the starter row merely employed the ordinary sheet metal roofing shingles used on the rest of the roof, or parts of the ordinary roofing shingles. An example of using a starter shingle row made up of part of the ordinary roofing shingles is shown in applicant's copending application, Ser. No. 789,730 now U.S. Pat. No. 4,079,561. In this application, relating to square sheet metal shingles, the starter row comprises starter shingles formed by cutting the square roofing shingles diagonally in half. The triangular starter shingles, while satisfactory, are relatively difficult to handle, being small in size. More importantly, since the triangular starter shingles do not interlock, the adjacent angled edges of adjacent shingles may not always end up square and additional care must be taken to properly locate and secure these starter shingles otherwise assembly problems with the interlocking roofing shingles can result.

The present invention provides improved starter shingles, made of sheet material, which are easy to lay, and more importantly which interlock with each other and with the eave edge of a roof in a manner permitting accurate alignment of roofing shingles laid in succeeding rows on the roof. The starter shingles are constructed to avoid horizontal joints and to start the roofing shingles off at an angle to the roof eave. The starter shingles can be laid rapidly since only one fastener is necessary to lock each shingle in place, and little on-the-job cutting and/or fitting is required. The improved starter shingles can also be made fairly large thus reducing the number of shingles required to cover a given roof area and permitting the roof covering to be laid quicker.

A roof covering employing the improved starter shingles can be laid much quicker because of the initial accurate alignment of the first row of roofing shingles, and thus the accurate alignment of the remaining roofing shingle rows.

The roof covering of the present invention preferably employs roofing shingles which are rectangular in shape and are sized to cooperate with the starter shingles to provide aesthetically pleasing shingle patterns.

The roof covering of the present invention further employs sheet material components for aligning and retaining the shingles at both the eave and gable edges of a roof. These components reduce the fasteners required for shingling and permit the shingles to be laid more rapidly. The roof covering also employs novel sheet material ridge shingles for completing the roof, which ridge shingles can be quickly laid in weathertight manner with a minimum number of fasteners.

The invention, in one embodiment, is particularly directed toward a sheet material starter shingle having a first straight side with means for engaging the eave edge of a roof and second and third straight sides extending perpendicularly from the first side. The shingle includes fourth and fifth straight sides angled toward each other from the second and third sides and meeting to define a peak opposite the first side. The second, third, fourth and fifth sides have means for engaging with other shingles laid adjacent these sides.

The invention in one preferred embodiment is directed to a sheet material starter shingle for use in shingling a roof; the starter shingle having a first straight side with means for engaging the eave edge of a roof and second and third straight sides extending perpendicularly from the first side. The shingle includes fourth and fifth straight sides which extend toward each other at an angle of 45° to the second and third sides and meeting to define a peak opposite to the first side; the second, third, fourth and fifth sides having means for engaging with other shingles laid adjacent these sides.

The invention is also directed toward a roof covering having a row of sheet material starter shingles and a plurality of sheet material roofing shingles. Each starter shingle has a first straight side with means for engaging the eave edge of a roof and second and third straight sides extending perpendicularly from the first side. The shingle includes fourth and fifth straight sides angled toward each other from the second and third sides and meeting to define a peak opposite the first side. Means are provided on the second and third sides for engaging with adjacent starter shingles and means are provided on the fourth and fifth sides for engaging with adjacent roofing shingles.

The roofing shingles are preferably rectangular in shape having a length equal to twice their width and with the width equal to the length of the fourth side of the starter shingle.

The invention is also directed toward a method for use in laying a roof covering with sheet material starter and roofing shingles. The method comprises laying a row of starter shingles along the eave of a roof, with each starter shingle engaged along a vertical edge to the preceding starter shingle and along a horizontal edge to the eave edge. A first row of rectangular roofing shingles is laid next with each full shingle engaged along one short side with one starter shingle and along one long side with a second starter shingle adjacent the one starter shingle and an adjacent roofing shingle laid in the first row. Each succeeding row of roofing shingles is laid with each full shingle engaged along one short side with one roofing shingle in the previous row, and along one long side with a second roofing shingle in the previous row adjacent the one roofing shingle and an adjacent roofing shingle laid in the present row.

The invention will now be described in detail having reference to the accompanying drawings in which.

Figure 1:
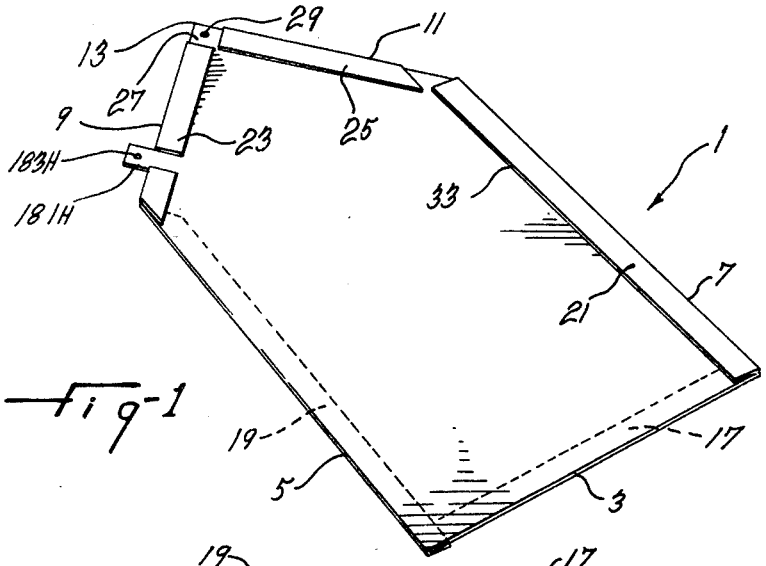
FIG. 1 is a perspective view of the starter shingle of the present invention.
Figure 3:
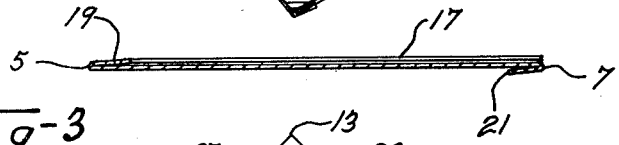
FIG. 3 is a cross-section view taken along line 3—3 of FIG. 2.
Figure 2:
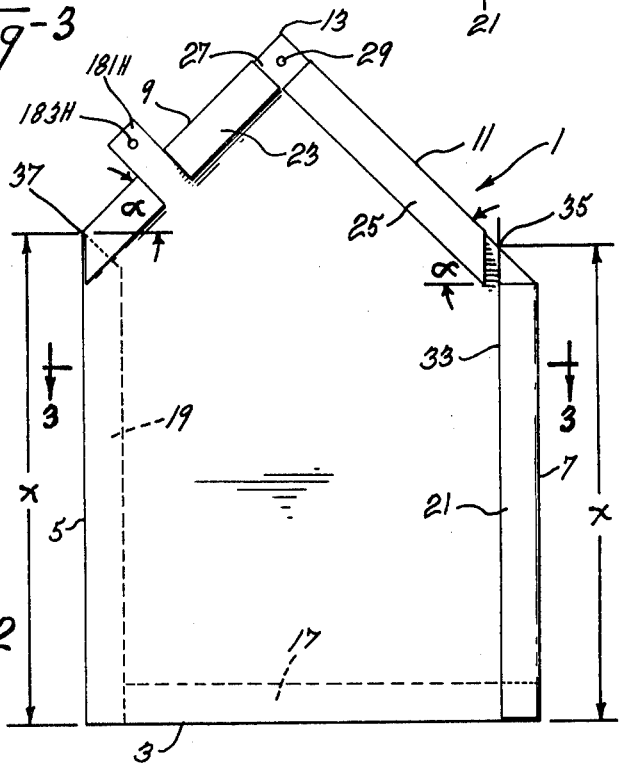
FIG. 2 is a plan view of the starter shingle.

In accordance with the present invention, the starter shingle 1, shown in FIGS. 1, 2 and 3, is made from sheet material and has the shape of a five-sided figure. More particularly, the starter shingle 1 has a first, straight bottom side 3 adapted to engage a roof eave edge as will be described. Second and third straight, vertical sides 5, 7 extend perpendicularly from the first side 3 and are adapted to engage the vertical sides of adjacent starter shingles. Fourth and fifth straight, top sides 9, 11 are angled toward each from the second and third sides 5, 7 respectively and meet to define a peak 13 opposite bottom side 3. Top sides 9, 11 are adapted to engage with roofing shingles as will be described. Each side 9, 11 preferably extends at an angle $\alpha$, to the vertical, of 45°.

Means are provided on the sides of the starter shingle 1 for engaging with the eave edge, the adjacent starter shingles, and the roof shingles. The engaging means can comprise an underturned lip 17 on the bottom side 3 and an underturned lip 19 on one vertical side 5. The other vertical side 7 has an overturned lip 21 and overturned lips 23, 25 are provided on top sides 9, 11 respectively. The engaging lips 23, 25 on top sides 9, 11 are cut back adjacent peak 13 leaving an exposed fastening area 27 on the top of the shingle. An aperture 29, for receiving a fastener, can be provided centrally in area 27.

In order to provide a uniform appearance when the starter shingles are laid in a starter row on a roof, one of the vertical sides 7 preferably is shorter than the other vertical side 5. The overturned lip 21 of vertical side 7 is then sized so that its vertical engaging edge 33, if projected upwardly, intersects top side 11 at a point 35 which is located a distance "X" up from bottom side 3. This distance "X" is the same distance that the corner 37, at the junction of sides 5, 9 is located up from bottom side 3, as shown in FIG. 2.

Figure 4:
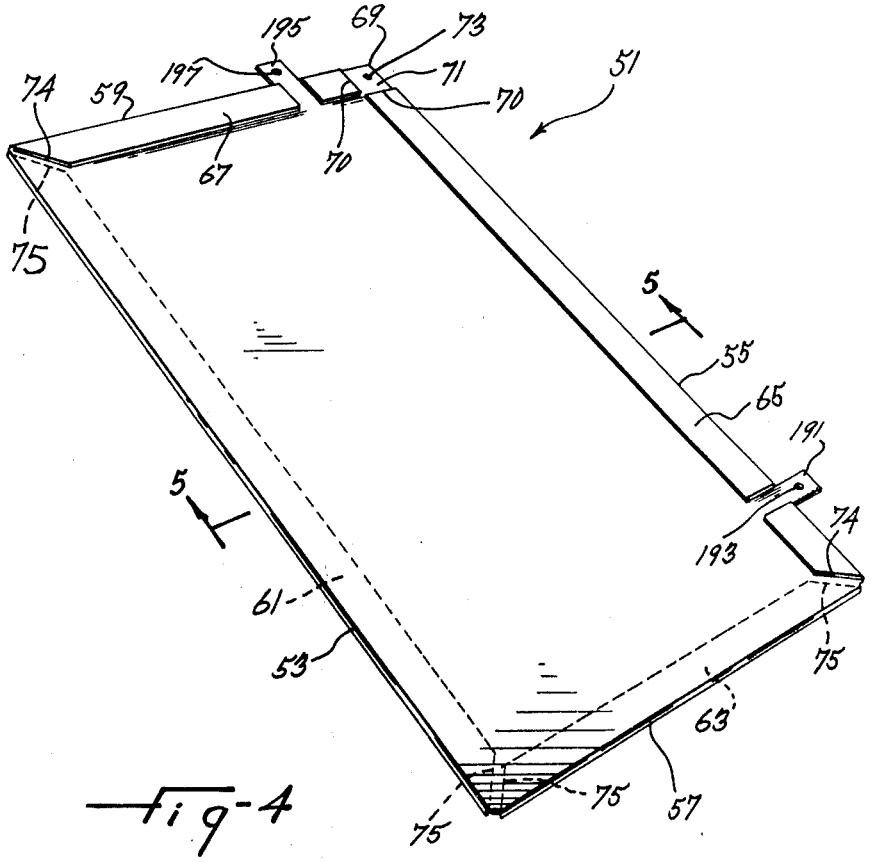
FIG. 4 is a perspective view of a roofing shingle.
Figure 5:
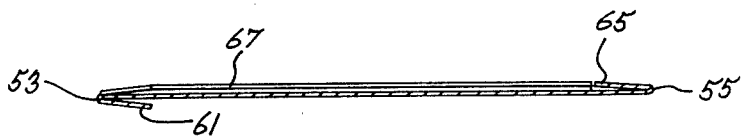
FIG. 5 is a cross-section view taken along line 5—5 of FIG. 4.
Figures 13, 15, 16, 17:
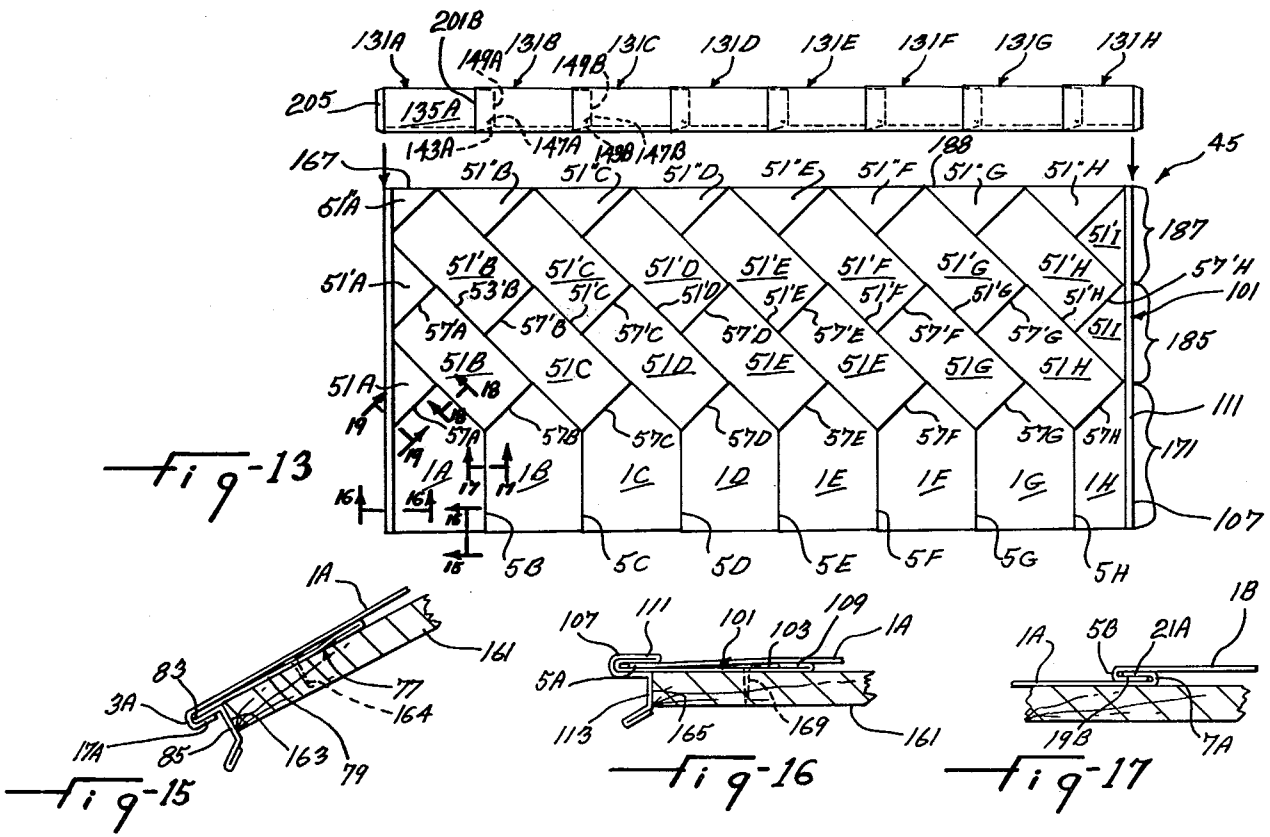
FIG. 13 is a plan view of a roof covering.
FIG. 15 is a cross-section view taken along line 15—15 of FIG. 13.
FIG. 16 is a cross-section view taken along line 16—16 of FIG. 13.
FIG. 17 is a cross-section view taken along line 17—17 of FIG. 13.

This same result can be achieved by ensuring that the width of underturned lip 19 is such that when underturned lip 19 of a starter shingle is engaged with overturned lip 21 of the previous starter shingle, side 5 will overlap side 7 of the previous starter shingle and will be located to the left of side 7 a distance such that side 5 will extend up to point 35 on side 11 of the previous starter shingle. The starter shingles 1 form part of a roof covering 45 as shown in FIG. 13. The roof covering 45 also includes roofing shingles 51. The roofing shingles 51 are also made from sheet material and have a quadrangular shape. Preferably, the roofing shingles have a rectangular shape with two long sides 53, 55 and two short sides 57, 59 as shown in FIGS. 4 and 5. One long side 53 and an adjacent short side 57, forming the bottom sides of the shingle, have engaging means in the form of underturned lips 61, 63 respectively. The other two adjacent sides 55, 59 forming the top sides of the shingle, have engaging means in the form of overturned lips 65, 67. At the top corner 69 of the shingle, the ends 70 of overturned lips 65, 67 are cut back providing an open fastening area 71. An aperture 73 may be provided in the center of the fastening area 71 for receiving a fastener used to fasten the shingle. Preferably the other ends 74 of lips 65, 67 and the ends 75 of underturned lips 61, 63 are cut at a 45 angle which facilitates forming of the shingle.

In accordance with the present invention the roofing shingle 51 has a width which is equal to the length of shorter top side 9 of a starting shingle 1. The length of shingle 51 is preferably twice its width.

Figure 6:
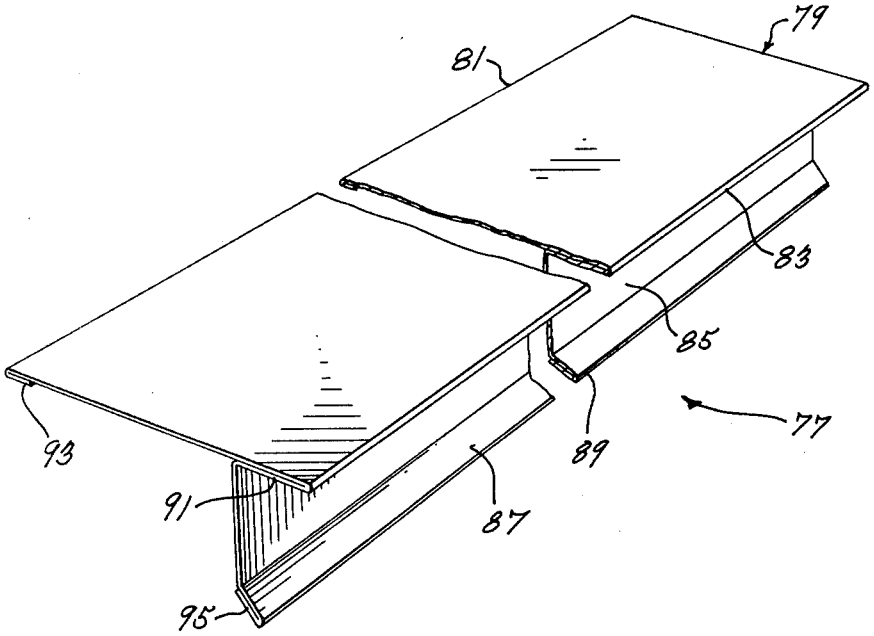
FIG. 6 is a perspective view of an eave member.
Figure 7:
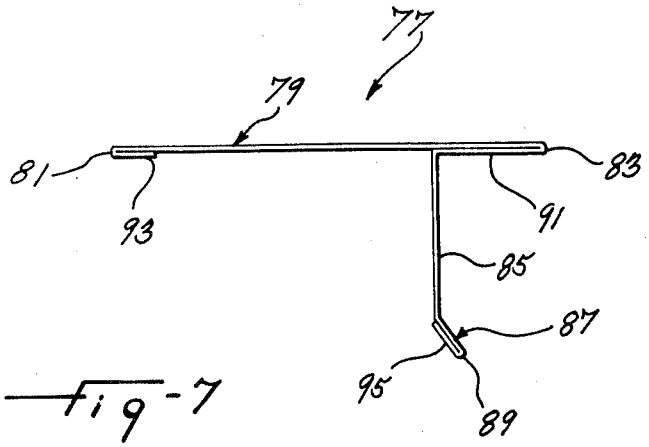
FIG. 7 is an end view of the eave member.

The roof covering 45 includes a sheet material eave member 77. The eave member 77 is placed on the roof adjacent the eave of the roof to protect the eave. The eave member 77 also provides means on which the row of starter shingles 1 are engaged. The eave member 77 as shown in FIGS. 6 and 7 comprises an eave strip 79 having inner and outer edges 81, 83. A web 85 extends down from the eave strip 79 generally perpendicular thereto. The web 85 is spaced inwardly a short distance from outer edge 83. A narrow drip strip 87, is angled outwardly from the bottom of web 85, terminating in a free drip edge 89. The eave member 77 can be formed from a single piece of sheet material, folded to provide the eave strip, web, and drip strip. The sheet material is folded over at outer edge 83 to provide a double thickness eave strip portion 91 between edge 83 and web 85. This doubled eave strip portion 91, which projects past web 85, provides a rigid mounting for the starter shingles 1 with projecting straight outer edge 83 serving as a datum line to start the shingles off properly aligned. The inner edge 81 of eave strip 79 and the drip edge 89 are preferably formed by folding under narrow edge portions 93, 95 of eave strip 79 and drip strip 87 respectively.

Figure 8:
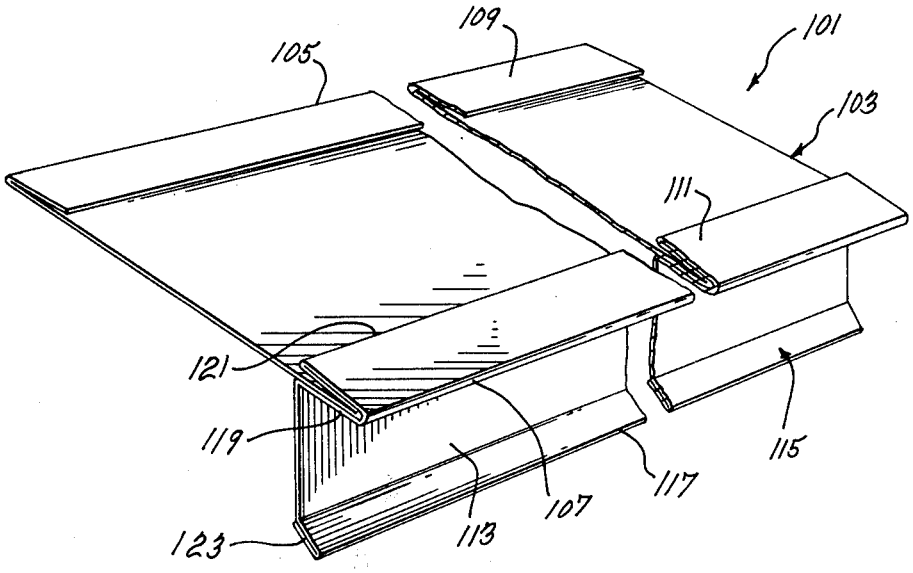
FIG. 8 is a perspective view of a gable member.
Figure 9:
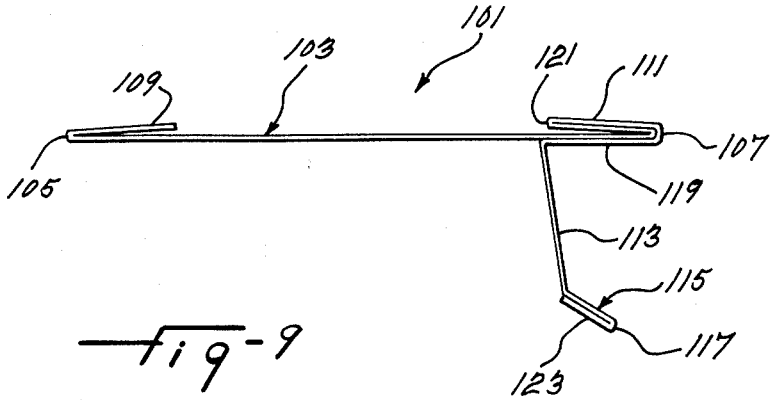
FIG. 9 is an end view of the gable member.

Gable members 101 are also employed in the roof covering 45. A gable member 101, shown in FIGS. 8 and 9, is placed on the roof adjacent each gable edge. The gable members 101 protect the gable edges and also locate and aid in fastening the shingles. Each gable member 101 comprises a gable strip 103 having inner and outer edges 105, 107. The edges 105, 107 are formed by folding over narrow edge portions 109, 111 of strip 103. A web 113 extends down from gable strip, generally perpendicular thereto. The web 113 is located a short distance inwardly from outer edge 107. A narrow drip strip 115 extends outwardly and downwardly from the bottom of web 113, having a free drip edge 117.

As with the eave member, the gable member 101 can be formed from a single piece of sheet material, folded to provide the gable strip, web, and drip strip. The portion 119 of the gable strip 103, projecting past web 113 is doubled, folded over at the inner edge 121 of outer edge portion 111. A narrow edge portion 123 of drip strip 115 is also folded under.

Figure 10:
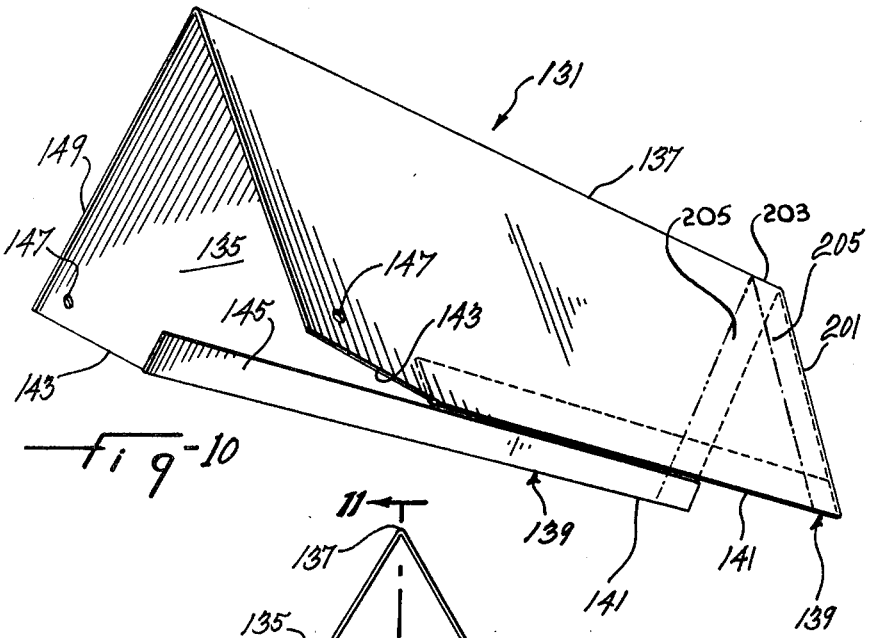
FIG. 10 is a perspective view of a ridge shingle.
Figure 11:
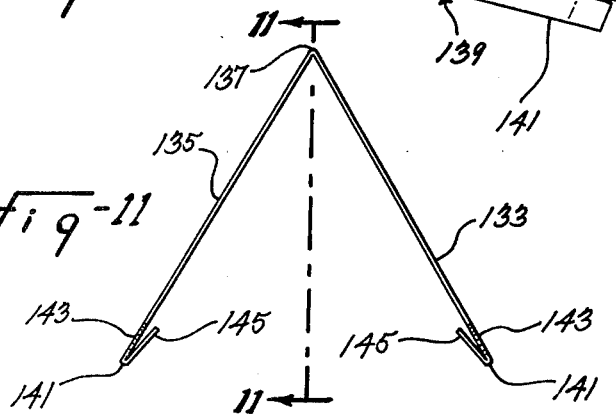
FIG. 11 is an end view of the ridge shingle.
Figure 12:
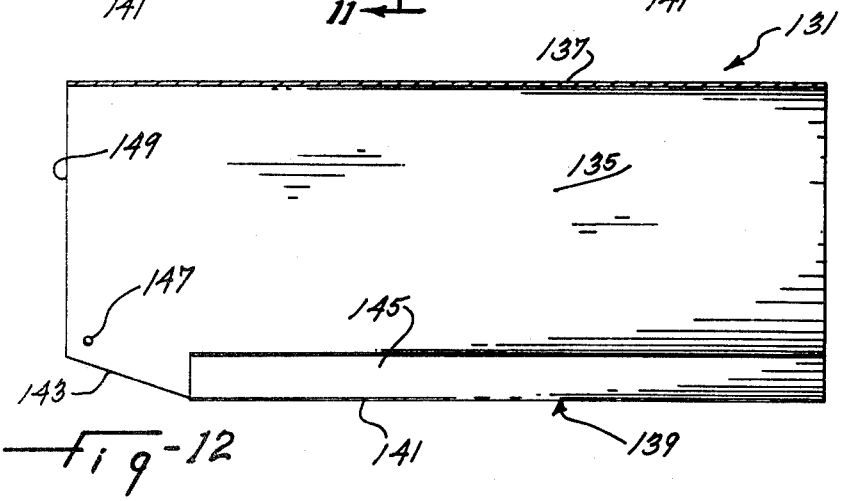
FIG. 12 is a cross-section view taken along line 11—11 of FIG. 11.

The roof covering 45 includes ridge shingles 131. As shown in FIGS. 10 to 12, each ridge shingle 131, made from sheet material, comprises a pair of generally rectangular panels 133, 135 joined together at adjacent long sides, along a ridge line 137. The other free long side 139 of each panel has a relatively long straight portion 141, parallel to ridge line 137, and a short straight portion 143 extending upwardly at a slight angle relative to portion 141. Each side portion 141 has an underturned lip 145 along its length. An aperture 147 is provided in each panel just above angled side portion 143, adjacent end edge 149 of each panel.

All the roof covering members and shingles are preferably made from sheet metal, although other sheet material, such as plastic, can be used.

The roof covering 45 employing the above described components is shown in FIG. 13. To construct the roof covering 45, an eave member 77 is first fastened to the roof 161 along its eave edge 163. The eave member 77 is positioned with its eave strip 79 on the roof 161 and with web 85 adjacent eave edge 163 as shown in FIG. 15. The member 77 is positioned to have its outer edge 83 square with the roof and it is then fastened to the roof with fasteners 164, such as nails, driven through the strip 79. The eave member 77 extends across the roof from gable edge to gable edge.

A gable member 101 is then fastened to the roof 161 along each gable edge 165 extending from the eave edge 163 to the ridge 167, and overlying the eave member 77. The gable strip 103 is placed flat on the roof 161 with the web 113 lying adjacent gable edge 165 as shown in FIG. 16. The gable member 101 is fastened to the roof with fasteners 169, such as nails, driven through the gable strip 103.

Figure 18:
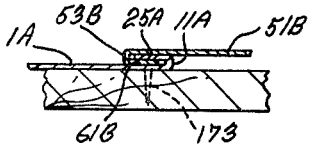
FIG. 18 is a cross-section view taken along line 18—18 of FIG. 13.
Figure 19:
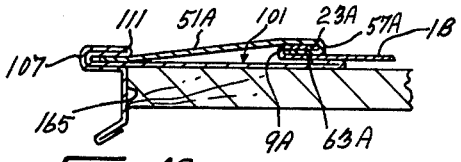
FIG. 19 is a cross-section view taken along line 19—19 of FIG. 13.

Starter shingles 1 are now laid on the roof 161 in a first starter row 171. The first starter shingle 1*a* in row 171, to the left hand side as shown in FIG. 13, is laid first. This shingle 1*a* is positioned on the roof with the lip 17*a* on the bottom side 3*a* hooked over projecting outer edge 83 of eave member 77 as shown in FIG. 15. The shingle 1*a* is pushed up to have its bottom side 3*a* tight against edge 83. The shingle 1*a* is also moved to the left to slide its vertical side 5*a* under the overturned edge or lip 111 of gable member 101 on the left side of the roof. The shingle is pushed to have its side 5*a* tight against outer edge 107 beneath lip 111. Lip 111 holds the left hand side of shingle 1*a* down. A fastener 173 such as a nail, as shown in FIG. 18 is nailed through the aperture 29 at the peak 13 of the shingle to secure it in place. The shingle 1*a* overlies inner overturned portion or lip 109 of strip 103. This lip 109 serves as a water stop in case any water gets under the shingles at the gable edges.

Figure 21:
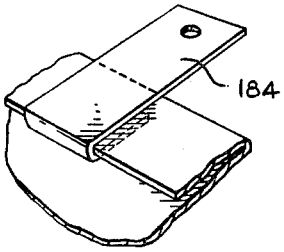
FIG. 21 is a perspective view of a clip.

The second starter shingle 1*b* is laid next having its down turned lip 19*b* on side 5*b* hooked tightly over the overturned lip 21*a* on side 7*a* of first shingle 1*a*, as shown in FIG. 17, so that shingle 1*b* overlaps shingle 1*a*. In addition, the lip 17*b* on its bottom side 3*b* is hooked over projecting outer edge 83 of eave member 77 in the same manner as lip 17*a* on shingle 1*a*. Shingle 1*b* is fastened to the roof with a fastener through the aperture at its peak. The remaining shingles 1*c*, 1*d*, etc., of the starter row are laid in similar fashion, each starter shingle hooked to the eave member, and the preceding starter shingle, and fastened with a single fastener. The last shingle 1*h* is cut on its right side, if necessary, along a line parallel to left side 5*h*, to fit in the space between the second last shingle 1*g* and the outer edge 107 of the right hand side gable member 101. The shingle 1*h* is slid under the overturned edge or lip 111 of gable member 101 while also hooked over the preceding shingle 1*g* and eave edge 83. A nail fastens it in place. If the shingle 1*h* is cut so narrow that fastening aperture 29 is removed, a clip 184 as shown in FIG. 21 can be employed to secure shingle 1*h* in place. Alternatively, a tab 181*h* can be cut from lip 23 on side 9 as shown in FIG. 1, and an aperture 183*h* provided in the tab 181*h* receives a fastener to fix shingle 1*h* to the roof.

Upon completion of the starter row 171, the roofing shingles 51 are laid next. The roofing shingles 51 can be laid in rows, 185, 187, etc. one above the other. To lay the first row 185 of roofing shingles 51, the first shingle 51*a* to the left of the row 185 is laid first. This shingle 51*a* is laid with its bottom short side 57*a* parallel to top side 9*a* of starter shingle 1*a*. The underturned lip 63*a* on side 57*a* is hooked over the overturned lip 23*a* on side 9*a* of shingle 1*a*. The shingle 51*a* is cut to fit to gable edge 165, and more particularly to fit flush against the edge 107 of gable member 101 under lip 111. The shingle 51*a* is cut on a line extending at an angle of 45° to bottom side 57*a* from the corner where sides 53*a*, 57*a* meet. A tab 119 shown in FIG. 4, can be formed from lip 65*a* on side 55*a* with an aperture 193 therein to receive a fastener for fastening shingle 51*a* to the roof. Alternatively, a clip 184 as shown in FIG. 21 can be used to fix shingle 51*a* in place.

When shingle 51*a* is fastened, its cut top side 55*a* forms a continuation of side 11*a* of shingle 1*a*. The second shingle 51*b* of row 185 is now laid with its side 53*b* adjacent sides 55*a*, 11*a* of shingles 51*a*, 1*a* respectively, and its side 57*b* adjacent side 9*b* of shingle 1*b*. Sides 11*a* and 9*b* of the two adjacent starter shingles 1*a*, 1*b* form a right angle corner receiving a corner of shingle 51*b*. Underturned lip 61*b* on side 53*b* of shingle 51*b* hooks over overturned lips 65*a*, 25*a* on sides 55*a*, 11*a* of shingles 51*a*, 1*a* as shown in part in FIG. 18. Underturned lip 63*b* on side 57*b* hooks over overturned lip of 23*b* on side 9*b* of shingle 1*b*. Shingle 51*b* is fastened to the roof with a fastener through aperture 73*b*. The remaining shingles 51*c*, 51*d*, etc., in row 185 are laid in a similar manner, each shingle engaged at its bottom end with two adjacent starter shingles and with the bottom half of the top long side of the previous roofing shingle in the row. The last shingle 51*i* in the row is laid in a similar manner except that it is cut along a line extending at 45 to the shingle sides to fit flush under lip 111 of right hand gable member 101. A nailing tab 195 with an aperture 197 can be formed from the overturned lip 67*i* on the upper narrow side 51*i* of the cut shingle 51*i*, as shown in FIG. 4.

The second row 187 of roofing shingles is laid next. The first shingle 51'*a* on the left hand side of the row 187 is laid first with its bottom short side 57'*a* against top short side 59*b* of the roof shingle 51*b* in row 185. The lip 57'*a* on shingle 51'*a* hooks over lip 67*b* on shingle 51*b*. Shingle 51'*a* is cut to fit against and under lip 111 of the left hand gable member 101. Side 55'*a* is aligned with side 55*b* of shingle 51*b*. Shingle 51'*a* is fastened with a fastener using a clip 184 or a tab similar to tab 191. The second shingle 51'*b* in row 187 is laid next, its side 53'*b* adjacent sides 55'*a* of shingle 51'*a* and 55*b* of shingle 51*b*. Side 57'*b* is adjacent side 59*c* of shingle 51*c*. The lip on side 53'*b* hooks over the lips on sides 55'*a*, 55*b* and the lip on side 57'*b* hooks over the lip on side 59*c*. Shingle 51'*b* is fastened to the roof at its top corner. The remaining shingles 51'*c*, 51'*d*, etc., are laid in a similar manner with the last shingle 51'*i* in the row cut and laid in the same manner as shingle 51*i* beneath it.

Additional roofing shingle rows are laid in the same manner. The shingles 51'' in the last row are cut along a horizontal line 188 extending at 45 to sides of the shingles to end generally flush with the ridge 167 of the roof. Each top shingle 51'' can be fastened with a nail adjacent its cut side 188.

The ridge shingles 131 are laid last. The first ridge shingle 131*a* is formed with underturned lips on the other ends 201 of panels 133, 135 opposite end 149. The lips can be formed by making a short cut 203 inwardly from end 201 along ridge line 137 and folding the so formed flaps 205 inwardly. The cut 203 and flaps 205 are shown by dot-dash lines in FIG. 10. This first shingle 131*a* is placed on the ridge overlying the roofing shingles 51 on either side of the roof with the lips hooked under the gable edges 107 on the left hand side of the roof. The other end of the ridge shingle 131*a* is fastened to the roof by fasteners through apertures 147*a*. The ends 201*b* of second ridge shingle 131*b* is slid over the ends 149*a* of the first shingle, covering the fasteners and with lips 145*b* sliding under and interlocking with edges 143*a*. Fasteners through apertures 147*b* fasten the shingle 131*b* to the roof. The remaining ridge shingles are fastened in a similar manner with the last shingle cut to fit and fold under the edge 107 of the right hand gable strip 101.

In this embodiment, shown in FIG. 13, each roofing shingle overlaps the adjacent shingles beneath it and to the left side. It will be seen that this results in no horizontal joints which minimizes water entry. The roofing shingles 51 are arranged in lines with each line of roofing shingles starting from a left hand top side 9 of a starter shingle 1 and extending up to the left at a 45° angle with the shingles in the line arranged end to end.

Figure 14:
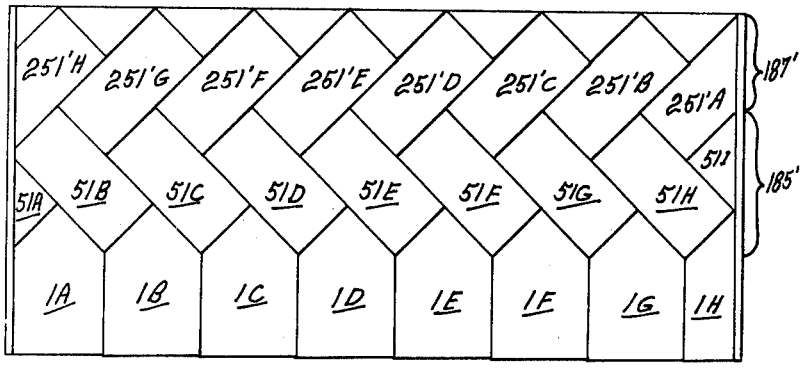
FIG. 14 is a plan view of another embodiment of a roof covering.
Figure 20:
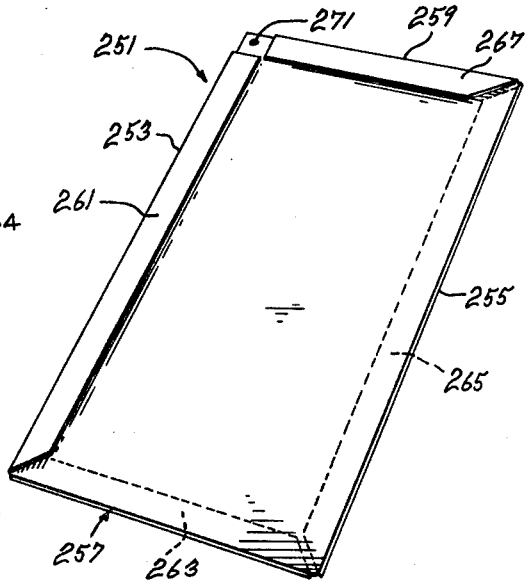
FIG. 20 is a perspective view of a modified roofing shingle.

In another embodiment, shown in FIG. 14, the roofing shingles can be arranged in a herringbone pattern with the roofing shingles 51 in the first row 185' extending up to the left at a 45° angle, the shingles 251' in the second row 187' extending up to right at a 45° angle and then repeating the pattern of the first two rows to the top of the roof. The herringbone pattern does require two slightly different forms of roofing shingles 51 however. The shingle 51 shown in FIG. 4 can be used for the first and each succeeding odd numbered row. For the second and every succeeding even numbered row however, a roofing shingle 251 as shown in FIG. 20 is used. This shingle 251 has two long sides 253, 255 and two narrow sides 257, 259. Sides 255 and 257 have underturned lips 265, 263 respectively and sides 253, 259 have overturned sides 261, 267 respectively. In the herringbone pattern, row 185' is laid first, from left to right when viewing FIG. 14. Row 187' is laid next, from right to left when viewing FIG. 14 with the underturned lips 263, 265 of shingle 251*a* hooked over overturned lips of shingles 51*i*, 51*h*. Next shingle 251'*b* in row 187' has its underturned lips on sides 255, 257 hooked over the adjacent overturned lips shingles 51*h*, 51*g* and shingle 251'*a*. The remaining shingles 251' in row 187' are laid in a similar manner. In the next row shingles 51 are employed, laid in the same manner as the shingles in row 185'. This alternating pattern is continued up the roof.

To further improve the waterproof properties of the roof, the fasteners 164 and 169 used to secure the eave member 77 and the gable members 101 can be sealed using a suitable sealing compound such as silicon. It has been found that the other fasteners used to secure the shingles are adequately protected by the design of the roof and do not require sealing.

I claim:

1. A sheet material starter shingle for use in shingling a roof; the starter shingle having a first straight side with an under-turned lip for engaging the eave edge of a roof, second and third straight sides extending perpendicularly from the first side with an underturned lip on the second side and an overturned lip on the third side for engaging with adjacent starter shingles; fourth and fifth straight sides extending inwardly at an angle of 45° to the second and third sides respectively and meeting to define a peak opposite the first side, the fourth and fifth sides each having an overturned lip for engaging with roofing shingles; the third side of the shingle being slightly shorter than the second side with the inner edge of the overturned lip on the third side located so that if the edge were extended to intersect the fifth side, it would do so at a distance from the first side, equal to the distance the corner between the second and fourth sides is located from the first side.

2. A roof covering having a row of sheet material starter shingles and a plurality of sheet material roofing shingles; each a starter shingle having an under-turned lip along one side for engaging with the eave edge of the roof; the majority of the starter shingles having parallel second and third sides perpendicular to the first side, the second side having an underturned lip and the third side having an overturned lip for engaging with adjacent starter shingles; the majority of the starter shingles having fourth and fifth sides extending inwardly at an angle of 45° to the second and third sides respectively and meeting to define a peak opposite the first side, the fourth side having an overturned lip for engaging with one roofing shingle, and the fifth side having an overturned lip for engaging with another roofing shingle; the third side of the shingle being slightly shorter than the second side with the inner edge of the over-turned lip on the third side located so that if the edge were extended to intersect the fifth side it would do so at a distance from the first side equal to the distance the corner between the second and fourth sides is located from the first side.

3. A roof covering as claimed in claim 2 wherein the majority of the roofing shingles are rectangular in shape having a length twice their width, and having a width equal to the length of the fourth side of the starting shingle.

4. A roof covering as claimed in claim 3 wherein each rectangular roofing shingle has two adjacent sides with overturned lips and the other two adjacent sides have underturned lips for engaging with adjacent shingles.

5. A roof covering as claimed in claim 4 wherein the overturned lips are cut back from the corner where they meet.

6. A roof covering as claimed in claim 2 including a sheet material eave member for attaching to the eave of a roof, the eave member having a straight projecting edge adapted to be engaged by the one side of the starter shingles.

7. A roof covering as claimed in claim 2 including a plurality of sheet material ridge shingles applied at the ridge of the roof to overlie the roofing shingles, and means on each ridge shingle for engaging with an end of the preceding ridge shingle which it overlaps.

8. A roof covering as claimed in claim 3 wherein the majority of the roofing shingles are arranged to extend up the roof in lines extending at an angle of 45° to the eave edge, the roofing shingles in each line laid end to end.

9. A roof covering having a row of sheet material starter shingles and a plurality of sheet material roofing shingles; each starter shingle having means along one side for engaging with the eave edge of the roof; the majority of the starter shingles having parallel second and third sides, perpendicular to the first side, with means on the second and third sides for engaging with adjacent starter shingles, the majority of the starter shingles having fourth and fifth sides angled together to meet at a peak opposite the one side; means on the fourth side for engaging with one roofing shingle and means on the fifth side for engaging with another roofing shingle; a sheet material gable member for attaching to the gable edges of a roof, the gable member having an overturned lip along each side and a drip edge below one side; the starter shingle and roofing shingles, adjacent each gable member, having one side slipped under the one overturned lip at the one side and lying over the other overturned lip.

10. A roof covering having a row of sheet material starter shingles and a plurality of sheet material roofing shingles; each starter shingle having an underturned lip along one side for engaging with the eave edge of the roof; the majority of the starter shingles having parallel second and third sides perpendicular to the first side with an underturned lip on the second side and an overturned lip on the third side for engaging with adjacent starter shingles; the third side being slightly shorter than the second side; the majority of the starter shingles having fourth and fifth sides extending at an angle of 45° to the second and third sides respectively to meet at a peak opposite the one side, an overturned lip on the fourth side for engaging with one roofing shingle and a overturned lip on the fifth side for engaging with another roofing shingle; the majority of the roofing shingles being rectangular in shape and having a length twice their width, each roofing shingle also having a width equal to the length of the fourth side of the starting shingle; the first row of roofing shingles extending at an angle of 45° to the eave edge, the second row of roofing shingles extending perpendicular to the first row of roofing shingles and each succeeding roofing shingle row extending perpendicular to each preceding roofing shingle row to form a herringbone pattern.

* * * * *